US010069194B2

(12) United States Patent
Cai et al.

(10) Patent No.: US 10,069,194 B2
(45) Date of Patent: Sep. 4, 2018

(54) ELECTRONIC DEVICE AND ANTENNA OF THE SAME

(71) Applicant: BYD COMPANY LIMITED, Shenzhen, Guangdong (CN)

(72) Inventors: Qinyang Cai, Guangdong (CN); Yijin Wang, Guangdong (CN); Wensong Wang, Guangdong (CN); Munyong Choi, Guangdong (CN)

(73) Assignee: BYD Company Limited (CN)

( * ) Notice: Subject to any disclaimer, the term of this patent is extended or adjusted under 35 U.S.C. 154(b) by 0 days.

(21) Appl. No.: 15/313,033

(22) PCT Filed: May 26, 2015

(86) PCT No.: PCT/CN2015/079774

§ 371 (c)(1),
(2) Date: Nov. 21, 2016

(87) PCT Pub. No.: WO2015/180619

PCT Pub. Date: Dec. 3, 2015

(65) Prior Publication Data

US 2017/0093022 A1 Mar. 30, 2017

(30) Foreign Application Priority Data

May 26, 2014 (CN) ..... 2014 1 0225498

(51) Int. Cl.
*H01Q 1/24* (2006.01)
*H01Q 13/10* (2006.01)

(52) U.S. Cl.
CPC ..... *H01Q 1/243* (2013.01); *H01Q 13/10* (2013.01)

(58) Field of Classification Search
CPC ..... H01Q 1/24; H01Q 1/243; H01Q 13/10
See application file for complete search history.

(56) References Cited

U.S. PATENT DOCUMENTS 4,197,545 A 4/1980 Favaloro et al.
2004/0257283 A1 12/2004 Asano et al.
(Continued)

FOREIGN PATENT DOCUMENTS

CN 101783435 A 7/2010
CN 101976765 A 2/2011
(Continued)

OTHER PUBLICATIONS

International Search Report from PCT Application No. PCT/CN2015/079774 dated Sep. 9, 2015.

*Primary Examiner* — Robert Karacsony
(74) *Attorney, Agent, or Firm* — Calfee, Halter & Griswold LLP

(57) ABSTRACT

An electric device includes a metal shell having a back metal shell part and a first side metal shell part, and a first antenna which includes: a first radiating surface formed by the back metal shell part and the first side metal shell part and having a variant T-shaped group of slots and a first L-shaped slot, a part of the variant T-shaped group of slots being formed in the back metal shell part, and the other part thereof being formed in the first side metal shell part, the first L-shaped slot being formed in the first side metal shell part; a first dielectric sheet disposed on a front surface of the back metal shell part; and a first L-shaped feeder disposed on a front surface of the first dielectric sheet.

14 Claims, 11 Drawing Sheets

(56) References Cited

U.S. PATENT DOCUMENTS

| | | | | |
|---|---|---|---|---|
| 2006/0132373 | A1 | 6/2006 | Yuanzhu | |
| 2011/0300907 | A1* | 12/2011 | Hill | H01Q 9/285 455/566 |
| 2012/0009884 | A1* | 1/2012 | Rao | H01Q 1/243 455/73 |
| 2013/0082884 | A1 | 4/2013 | Gummalla | |
| 2013/0194138 | A1 | 8/2013 | Hammond | |
| 2014/0184450 | A1* | 7/2014 | Koo | H01Q 5/335 343/702 |
| 2014/0218250 | A1* | 8/2014 | Kim | H01Q 13/106 343/767 |
| 2015/0270619 | A1* | 9/2015 | Zhu | G01V 3/00 343/702 |

FOREIGN PATENT DOCUMENTS

| | | | |
|---|---|---|---|
| CN | 102736686 | A | 10/2012 |
| CN | 103579754 | A | 2/2014 |
| CN | 103633434 | A | 3/2014 |
| CN | 103636064 | A | 3/2014 |
| CN | 103915690 | A | 7/2014 |
| KR | 1020060029616 | | 4/2006 |

* cited by examiner

ELECTRONIC DEVICE AND ANTENNA OF THE SAME

CROSS-REFERENCE TO RELATED APPLICATION

This application is a national phase of International Application No. PCT/CN2015/079774 filed May 26, 2015, which claims priority and benefits of Chinese Patent Application No. 201410225498.1, filed with State Intellectual Property Office, P.R.C. on May 26, 2014, the entire contents of which are incorporated herein by reference.

FIELD

Embodiments of the present disclosure generally relate to an electronic device, and more particularly, to an antenna of an electronic device.

BACKGROUND

Nowadays, a conventional antenna cannot be used in an electronic device with a full metal shell, since a signal of the antenna may be shielded and thus the antenna cannot work normally. Furthermore, the conventional antenna of the electronic device cannot cover WWAN (Wireless Wide Area Network).

SUMMARY

Embodiments of the present disclosure seek to solve at least one of the problems existing in the related art to at least some extent.

Embodiments of a first aspect of the present disclosure provide a first antenna of an electronic device, in which the electric device includes a metal shell which has a back metal shell part and a first side metal shell part, and the first antenna includes: a first radiating surface formed by the back metal shell part and the first side metal shell part and having a variant T-shaped group of slots and a first L-shaped slot, a part of the variant T-shaped group of slots being formed in the back metal shell part, and the other part of the variant T-shaped group of slots being formed in the first side metal shell part, the first L-shaped slot being formed in the first side metal shell part; a first dielectric sheet disposed on a front surface of the back metal shell part, a part of the first dielectric sheet being filled within or covering the variant T-shaped group of slots; and a first L-shaped feeder disposed on a front surface of the first dielectric sheet and having a first limb and a second limb, an edge of the first L-shaped feeder being located on an inner side of an edge of the first dielectric sheet.

With the first antenna of the electronic device according to embodiments of the present disclosure, by using the back metal shell part and the first side metal shell part as the first radiating surface, the first antenna will not be shielded by the metal shell. Moreover, the first antenna can cover a variety of electrical lengths of bands, that is, all the slots of the first antenna segments the metal shell into resonance branches, parasitic elements and resonant slots, which are used to cover the variety of electrical lengths of the bands, such that the first antenna can cover the WWAN. Furthermore, with a part of the first dielectric sheet being filled within or covering the variant T-shaped group of slots, it is assured that an appearance of the electronic device cannot be affected by the slots, such that the first antenna can be used for an actual product.

In some embodiments, the variant T-shaped group of slots includes: a first slot formed in the back metal shell part, a second slot formed in the first side metal shell part, a second L-shaped slot having a first limb and a second limb, and formed in the back metal shell part, a third L-shaped slot having a first limb and a second limb, and formed in the first side metal shell part, in which an inner end of the first slot is connected with the first limb of the second L-shaped slot, an outer end of the first slot is connected with an inner end of the second slot, an outer end of the second limb of the second L-shaped slot is connected with an inner end of the second limb of the third L-shaped slot, an outer edge of the first dielectric sheet is located on an outer side of an outer edge of the first limb of the second L-shaped slot, and an inner edge of the first dielectric sheet is located on an inner side of an inner edge of the first limb of the second L-shaped slot.

In some embodiments, the first L-shaped feeder has a first limb and a second limb, an inner edge of the first limb of the first L-shaped feeder is in flush with the outer edge of the first limb of the second L-shaped slot in a first inner and outer direction of the metal shell, an outer edge of the second limb of the first L-shaped feeder is located on the outer side of the outer edge of the first limb of the second L-shaped slot, and an inner edge of the second limb of the first L-shaped feeder is located on the inner side of the inner edge of the first limb of the second L-shaped slot.

In some embodiments, a first phase delay groove is formed in the second limb of the first L-shaped feeder, an outer edge of the first phase delay groove is located on the outer side of the outer edge of the first limb of the second L-shaped slot, and an inner edge of the first phase delay groove is located on the inner side of the inner edge of the first limb of the second L-shaped slot.

In some embodiments, a distance between the inner end of the first slot and the second limb of the second L-shaped slot is larger than a distance between the outer end of the first slot and the second limb of the second L-shaped slot.

Embodiments of a second aspect of the present disclosure provide a second antenna of an electronic device, in which the electronic device comprises a metal shell which has a back metal shell part and a first side metal shell part, and the antenna includes: a second radiating surface formed by the back metal shell part and the first side metal shell part and having a T-shaped slot and a fourth L-shaped slot, the T-shaped slot being formed in the first side metal shell part and having a first limb and a second limb, the fourth L-shaped slot being formed in the back metal shell part and having a first limb and a second limb, an outer end of the second limb of the fourth L-shaped slot being connected with an inner end of the first limb of the T-shaped slot; a second dielectric sheet disposed on a front surface of the back metal shell part, an outer edge of the second dielectric sheet being located on an outer side of an outer edge of the first limb of the fourth L-shaped slot, an inner edge of the second dielectric sheet being located on an inner side of an inner edge of the first limb of the fourth L-shaped slot, and a part of the second dielectric sheet being filled within or covering the fourth L-shaped slot; and a second L-shaped feeder disposed on front surface of the second dielectric sheet and having a first limb and a second limb, an edge of the second L-shaped feeder being located on an inner side of an edge of the second dielectric sheet.

With the second antenna of the electronic device according to embodiments of the present disclosure, by using the back metal shell part and the first side metal shell part as the second radiating surface, the second antenna will not be shielded by the metal shell, such that the second antenna can cover BT & Wifi. Moreover, with a part of the second dielectric sheet being filled within or covering the T-shaped slot, it is assured that the appearance of the electronic device cannot be affected by the slots, such that the second antenna can be used for the actual product.

In some embodiments, the first limb of the second L-shaped feeder is located on the outer side of the outer edge of the first limb of the fourth L-shaped slot, an outer edge of the second limb of the second L-shaped feeder is located on the outer side of the outer edge of the first limb of the fourth L-shaped slot, and an inner edge of the second limb of the second L-shaped feeder is located on the inner side of the inner edge of the first limb of the fourth L-shaped slot.

In some embodiments, a second phase delay groove is formed in the second limb of the second L-shaped feeder, an outer edge of the second phase delay groove is located on the outer side of the outer edge of the first limb of the fourth L-shaped slot, and an inner edge of the second phase delay groove is located on the inner side of the inner edge of the first limb of the fourth L-shaped slot.

Embodiments of a third aspect of the present disclosure provide an electronic device including: a metal shell, having a back metal shell part, a first side metal shell part and a second side metal shell part; and a first antenna with a first radiating surface formed by the back metal shell part and the first side metal shell part according to above embodiments of the present disclosure.

With the electronic device according to embodiments of the present disclosure, by using the back metal shell part and the first side metal shell part as the first radiating surface, the first antenna will not be shielded by the metal shell. Moreover, the first antenna can cover a variety of electrical lengths of bands, that is, all the slots of the first antenna segments the metal shell into resonance branches, parasitic elements and resonant slots, which are used to cover the variety of electrical lengths of the bands, such that the first antenna can cover the WWAN. Furthermore, with a part of the first dielectric sheet being filled within or covering the variant T-shaped group of slots, it is assured that an appearance of the electronic device cannot be affected by the slots, such that the first antenna can be used for an actual product. Moreover, the electric device has a reasonable structure, a strong practicability and a large use space and covers lots of bands.

In some embodiments, the electric device further includes a second antenna according to according to abatements of the present disclosure.

In some embodiments, the electric device includes a third antenna which includes: a third radiating surface formed by the back metal shell part and the second side metal shell part and having a third slot and a fifth L-shaped slot, the third slot being formed in the second side metal shell part, the fifth L-shaped slot having a first limb and a second limb and being formed in the back metal shell part, and an outer end of the first limb of the fifth L-shaped slot being connected with an inner end of the third slot; a third dielectric sheet disposed on an front surface of the back metal shell part, an outer edge of the third dielectric sheet is located on an outer side of an outer edge of the second limb of the fifth L-shaped slot, an inner edge of the third dielectric sheet being located on an inner side of an inner edge of the second limb of the fifth L-shaped slot, and a part of the third dielectric sheet being filled within or covering the fifth L-shaped slot; and a third L-shaped feeder disposed on front surface of the third dielectric sheet, an edge of the third L-shaped feeder being located on an inner side of an edge of the third dielectric sheet.

In some embodiments, the third L-shaped feeder has a first limb and a second limb, an inner edge of the second limb of the third L-shaped feeder is in flush with the outer edge of the second limb of the fifth L-shaped slot in a second inner and outer direction of the metal shell, an outer edge of the first limb of the third L-shaped feeder is located on the outer side of the outer edge of the second limb of the fifth L-shaped slot, and an inner edge of the first limb of the third L-shaped feeder is located on the inner side of the inner edge of the second limb of the fifth L-shaped slot.

In some embodiments, a third phase delay groove is formed in the first limb of the third L-shaped feeder, an outer edge of the third phase delay groove is located on the outer side of the outer edge of the second limb of the fifth L-shaped slot, and an inner edge of the third phase delay groove is located on the inner side of the inner edge of the second limb of the fifth L-shaped slot.

In some embodiments, the electric device further includes a fourth antenna, symmetrical to the second antenna with respect to a center line of the metal shell.

In some embodiments, the electric device further includes a fifth antenna, symmetrical to the first antenna with respect to a center line of the metal shell.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

DETAILED DESCRIPTION

Figure 1:
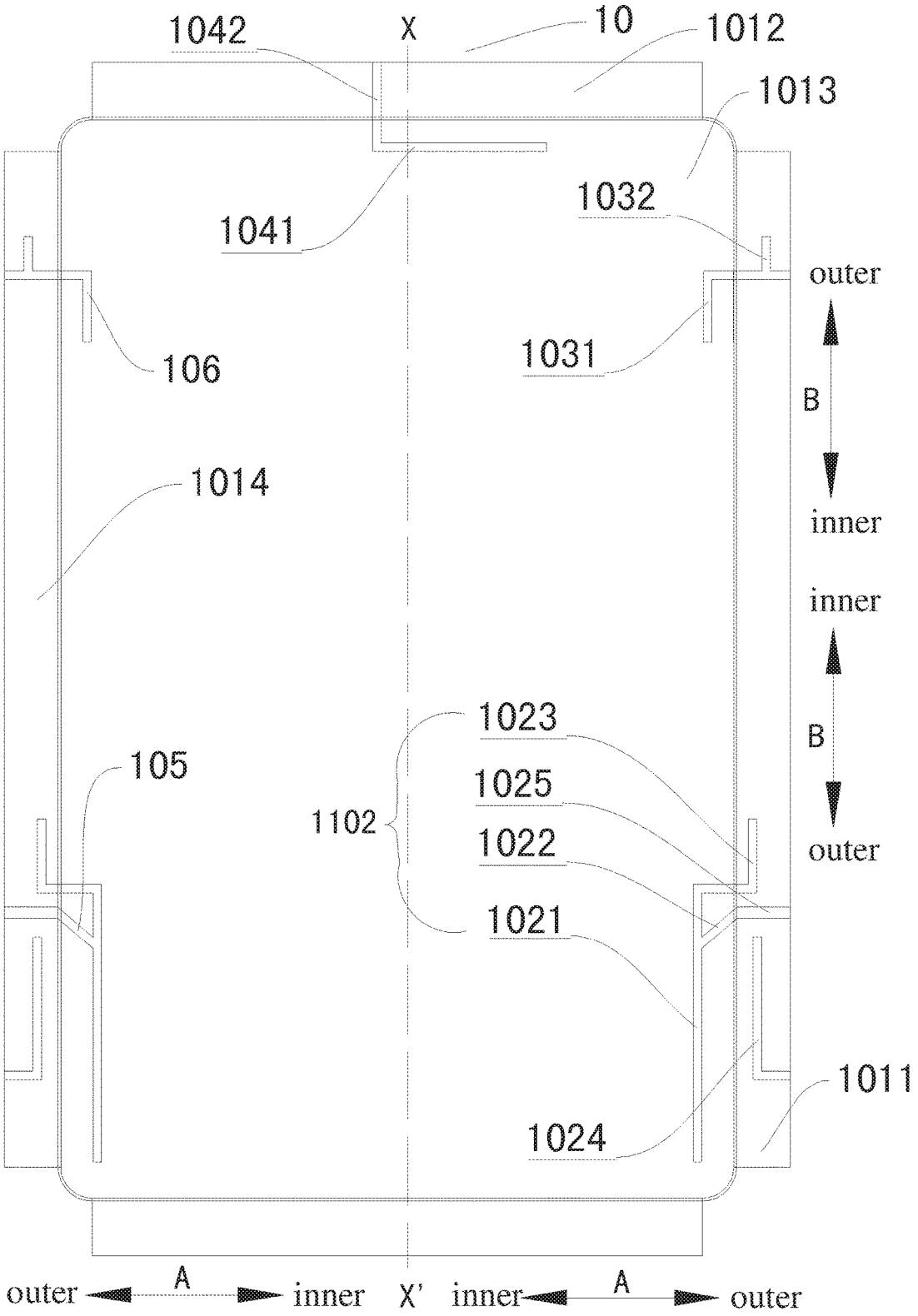
FIG. 1 is a rear expanded view of an electronic device according to an embodiment of the present disclosure.

Reference will be made in detail to embodiments of the present disclosure. Embodiments of the present disclosure will be shown in drawings, in which the same or similar elements and the elements having same or similar functions are denoted by like reference numerals throughout the descriptions. The embodiments described herein according to drawings are explanatory and illustrative, not construed to limit the present disclosure.

Various embodiments and examples are provided in the following description to implement different structures of the present disclosure. In order to simplify the present disclosure, certain elements and settings will be described. However, these elements and settings are only by way of example and are not intended to limit the present disclosure. In addition, reference numerals may be repeated in different examples in the present disclosure. This repeating is for the purpose of simplification and clarity and does not refer to relations between different embodiments and/or settings. Furthermore, examples of different processes and materials are provided in the present disclosure. However, it would be appreciated by those skilled in the art that other processes and/or materials may be also applied. Moreover, a structure in which a first feature is "on" a second feature may include an embodiment in which the first feature directly contacts the second feature, and may also include an embodiment in which an additional feature is formed between the first feature and the second feature so that the first feature does not directly contact the second feature.

In the description of the present disclosure, unless specified or limited otherwise, it should be noted that, terms "mounted," "connected" and "coupled" may be understood broadly, such as electronic connections or mechanical connections, inner communications between two elements, direct connections or indirect connections through intervening structures, which can be understood by those skilled in the art according to specific situations.

With reference to the following descriptions and drawings, these and other aspects of embodiments of the present disclosure will become apparent. In the descriptions and drawings, some particular embodiments are described in order to show the principles of embodiments according to the present disclosure, however, it should be appreciated that the scope of embodiments according to the present disclosure is not limited herein. On the contrary, changes, alternatives, and modifications can be made in the embodiments without departing from spirit, principles and scope of the attached claims.

In the following, an electronic device and an antenna of an electronic device are described in detail with reference to drawings.

FIG. 1 is a rear expanded view of an electronic device according to an embodiment of the present disclosure. As shown in FIG. 1, the electronic device 10 includes a metal shell, a first antenna 110, a second antenna 120, a third antenna 130, a fourth antenna 105 and a fifth antenna 106. The metal shell includes a back metal shell part 1013, a first side metal shell part 1011, a second side metal shell part 1012, and a third side metal shell part 1014.

Figure 2:
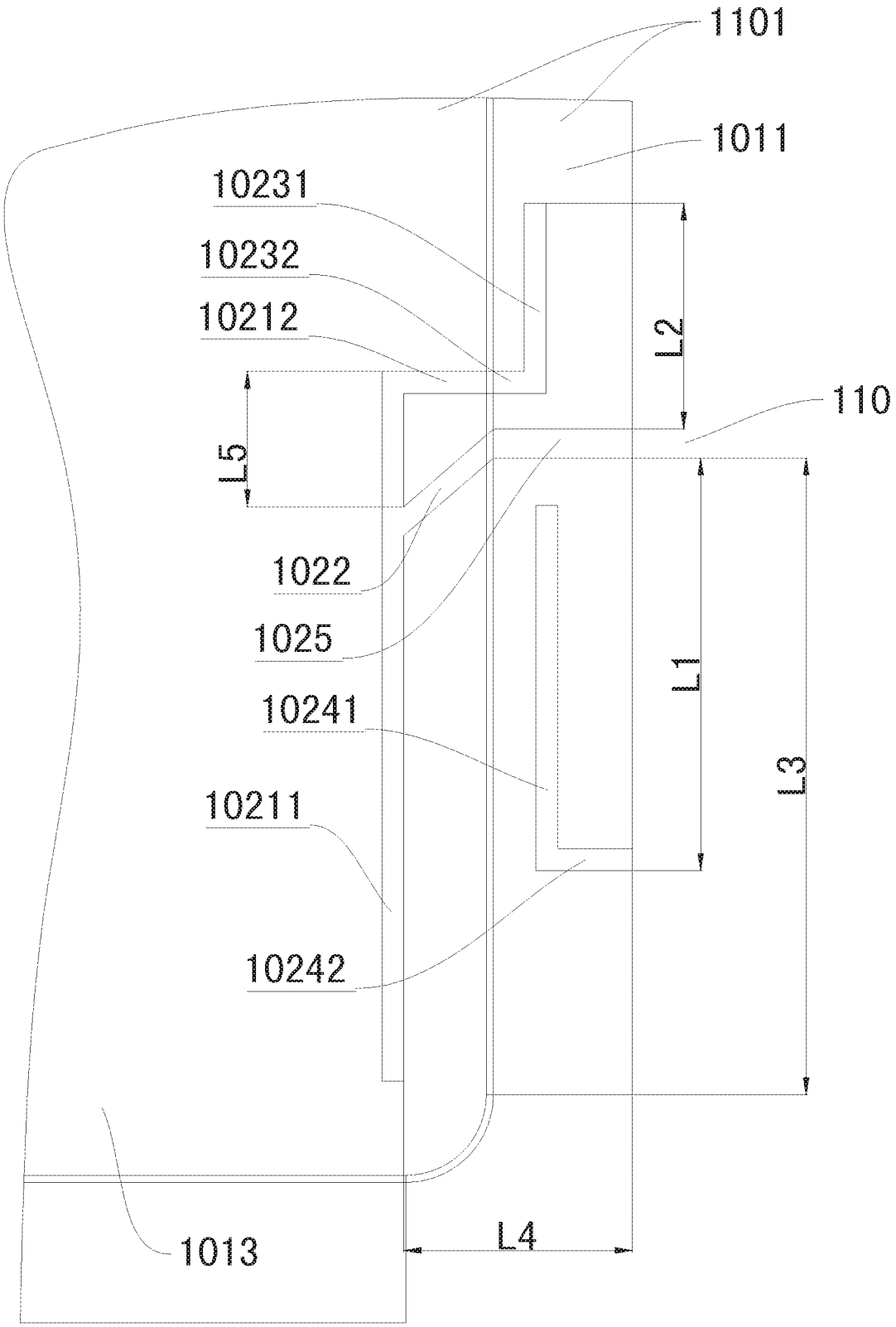
FIG. 2 is a schematic view of a first antenna according to an embodiment of the present disclosure.
Figure 5:
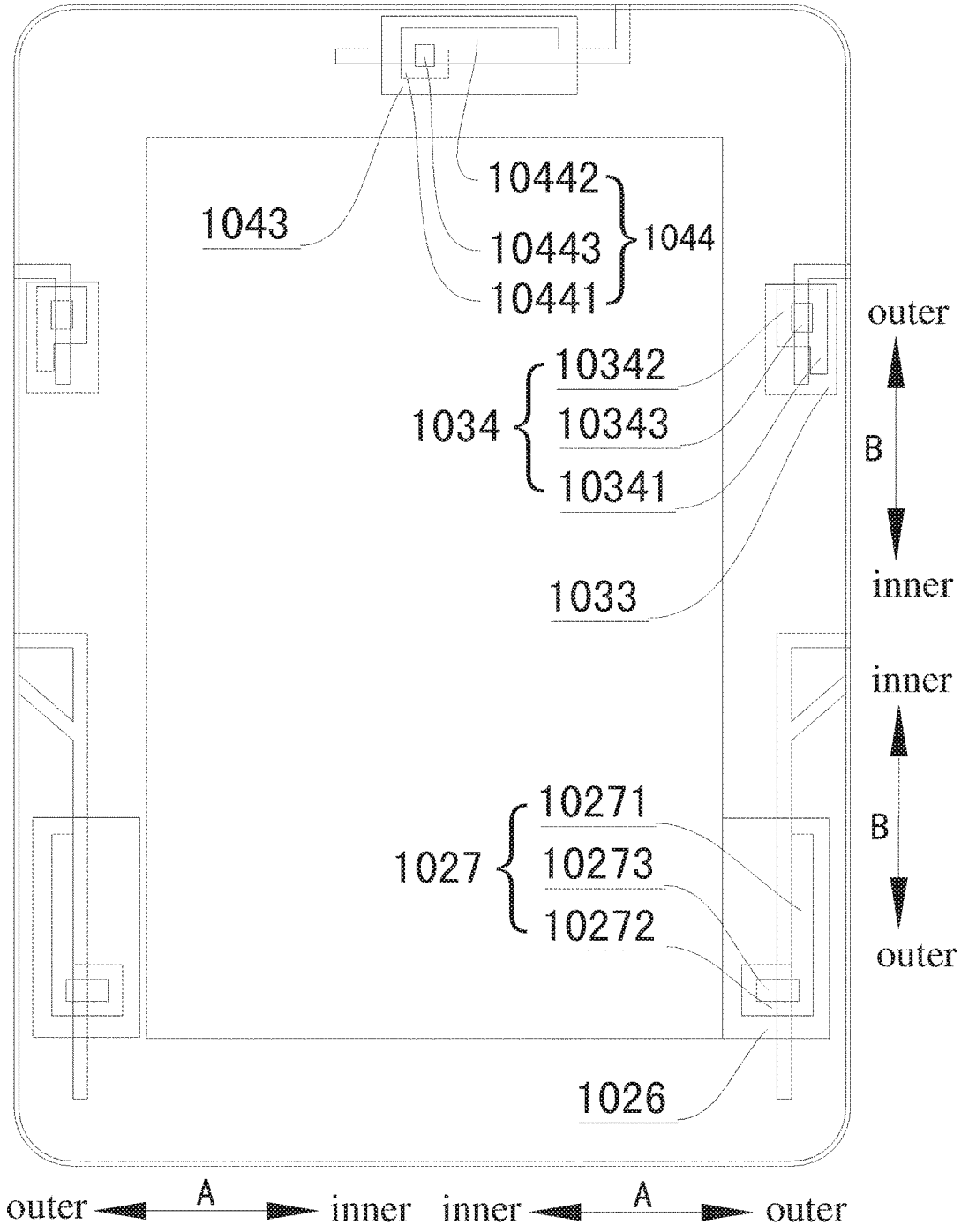
FIG. 5 is a schematic view of an electronic device according to an embodiment of the present disclosure.
Figure 6:
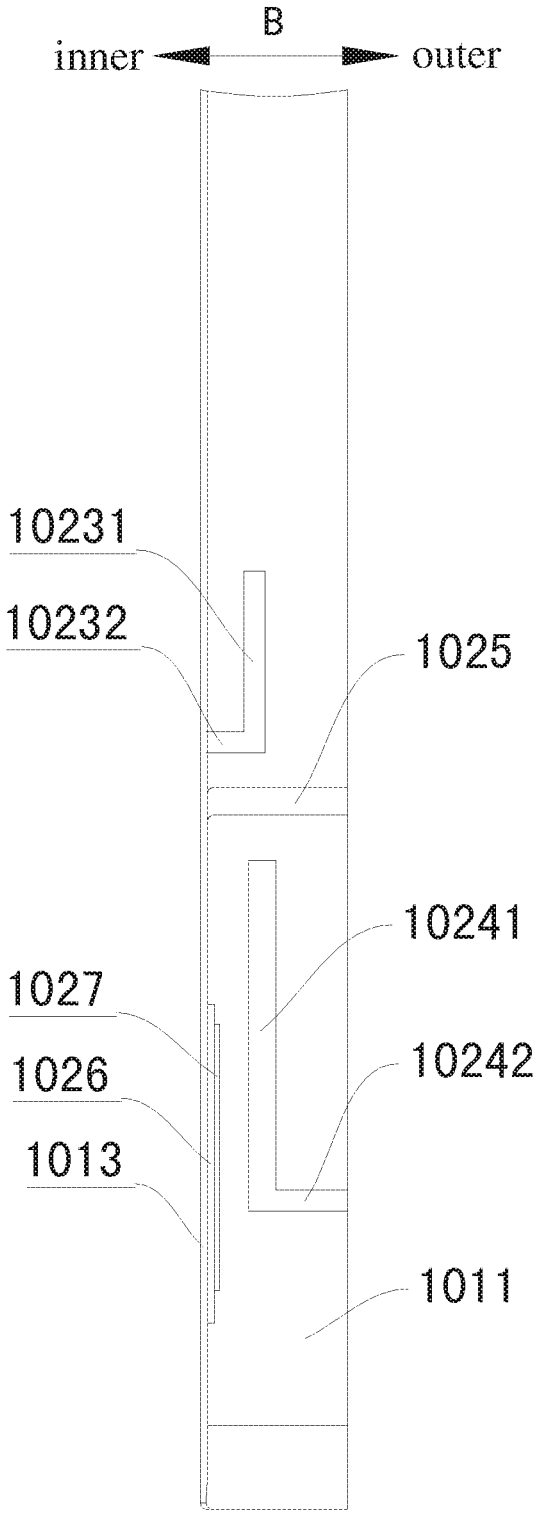
FIG. 6 is a right view of a first antenna according to an embodiment of the present disclosure.

FIG. 2 is a schematic view of a first antenna according to an embodiment of the present disclosure. FIG. 5 is a schematic view of an electronic device according to an embodiment of the present disclosure. FIG. 6 is a right view of an electronic device according to an embodiment of the present disclosure. As shown in FIGS. 1, 2, 5 and 6, the first antenna 110 of an electronic device 10 includes a first radiating surface 1101, a first dielectric sheet 1026 and a first L-shaped feeder 1027.

The first radiating surface 1101 includes the back metal shell part 1013 and the first side metal shell part 1011, that is, the back metal shell part 1013 and the first side metal shell part 1011 are used to form the first radiating surface 1101 of the first antenna 110. The first radiating surface 1101 has a variant T-shaped group 1102 of slots and a first L-shaped slot 1024, a part of the variant T-shaped group 1102 of slots is formed in the back metal shell part 1013, and the other part of the variant T-shaped group 1102 of slots is formed in the first side metal shell part 1011, and the first L-shaped slot 1024 is formed in the first side metal shell part 1011.

The first dielectric sheet 1026 is disposed on a front surface of the back metal shell part 1013, a part of the first dielectric sheet 1026 is filled within or covers the variant T-shaped group 1102 of slots. The first L-shaped feeder 1027 is disposed on a front surface of the first dielectric sheet 1026, and an edge of the first L-shaped feeder 1027 is located on an inner side of an edge of the first dielectric sheet 1026. In embodiments of the present disclosure, a front direction is perpendicular to paper and faces inward and a back direction is perpendicular to paper and faces outward.

With the first antenna 110 of the electronic device 10 according to embodiments of the present disclosure, by using the back metal shell part 1013 and the first side metal shell part 1011 as the first radiating surface 1101, the first antenna 110 will not be shielded by the metal shell. Moreover, the first antenna 110 can cover a variety of electrical lengths of bands, that is, all the slots of the first antenna 110 segment the metal shell into resonance branches, parasitic elements and resonant slots, which are used to cover the variety of electrical lengths of the bands, such that the first antenna 110 can cover the WWAN. Furthermore, with the part of the first dielectric sheet 1026 being filled within or covering the variant T-shaped group 1102 of slots, it is assured that an appearance of the electronic device 10 cannot be affected by the slots, such that the first antenna 110 can be used for an actual product.

Figure 7:
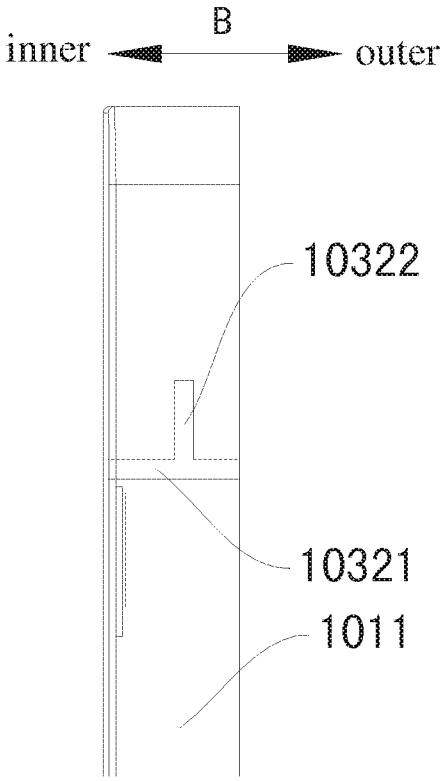
FIG. 7 is a right view of a second antenna according to an embodiment of the present disclosure.
Figure 8:
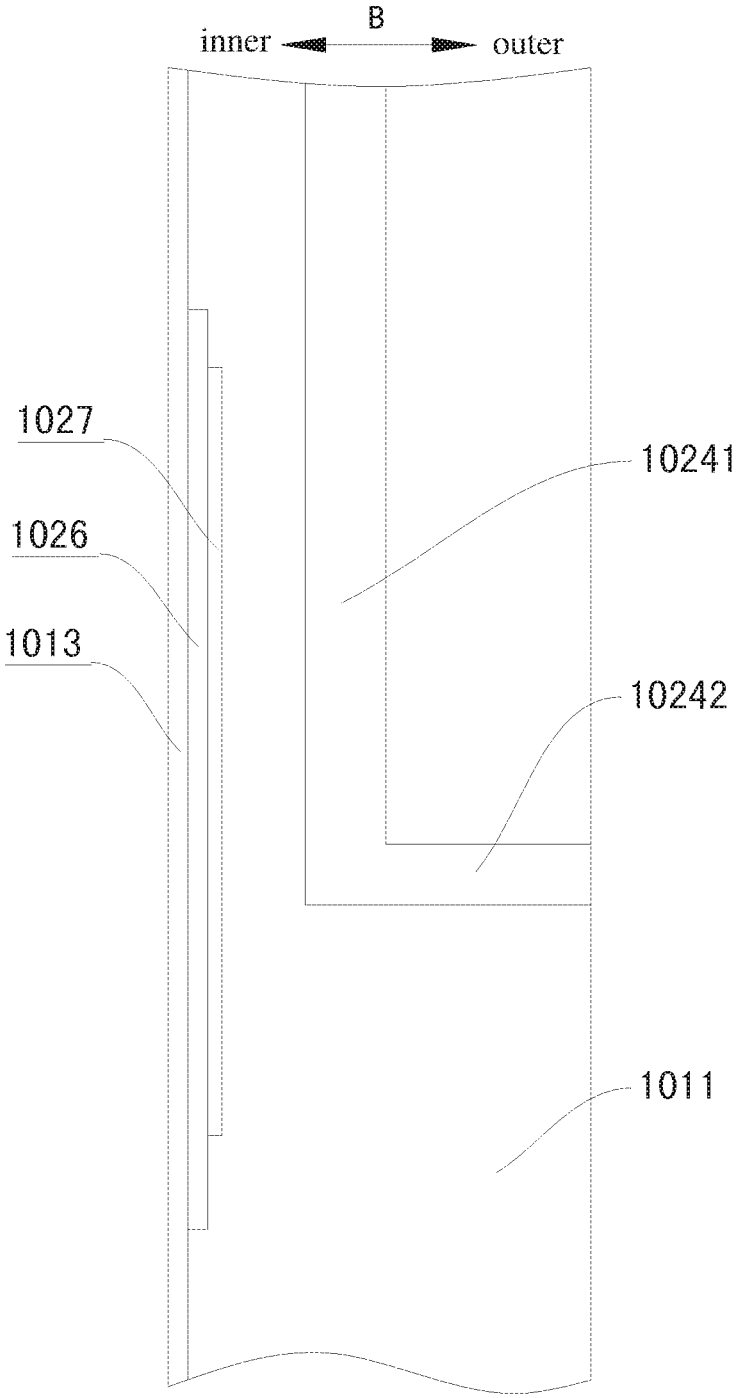
FIG. 8 is a partially right view of a first antenna according to an embodiment of the present disclosure.

FIG. 7 is a right view of a second antenna according to an embodiment of the present disclosure. FIG. 8 is a partially right view of a first antenna according to an embodiment of the present disclosure. In an embodiment, a first inner and outer direction A of the metal shell is shown in FIGS. 6-8 and a second inner and outer direction B is shown in FIGS. 1 and 5. A direction oriented from outside to a center of the back metal shell is inward, and a direction oriented from the center of the back metal shell to outside is outward.

As shown in FIGS. 1, 2, 5 and 6, the variant T-shaped group 1102 of slots includes a first slot 1022, a second slot 1025, a second L-shaped slot 1021 having a first limb 10211 and a second limb 10212, and a third L-shaped slot 1023 having a first limb 10231 and a second limb 10232. The second L-shaped slot 1021 and the first slot 1022 are formed in the back metal shell part 1013 respectively, and the third L-shaped slot 1023 and the second slot 1025 are formed in the first side metal shell part 1011 respectively. An inner end of the first slot 1022 is connected with the first limb 10211 of the second L-shaped slot 1021, an outer end of the first slot 1022 is connected with an inner end of the second slot 1025, an outer end of the second limb 10212 of the second L-shaped slot 1021 is connected with an inner end of the second limb 10232 of the third L-shaped slot 1023, an outer edge of the first dielectric sheet 1026 is located on an outer side of an outer edge of the first limb 10211 of the second L-shaped slot 1021, and an inner edge of the first dielectric sheet 1026 is located on an inner side of an inner edge of the first limb 10211 of the second L-shaped slot 1021, such that the structure of the first antenna 110 can be more reasonable.

In addition, as shown in FIGS. 1, 2, 5 and 6, the first limb 10231 of the third L-shaped slot 1023 is located on the outer side of the outer edge of the second limb 10232 of the third L-shaped slot 1023.

Figure 14:
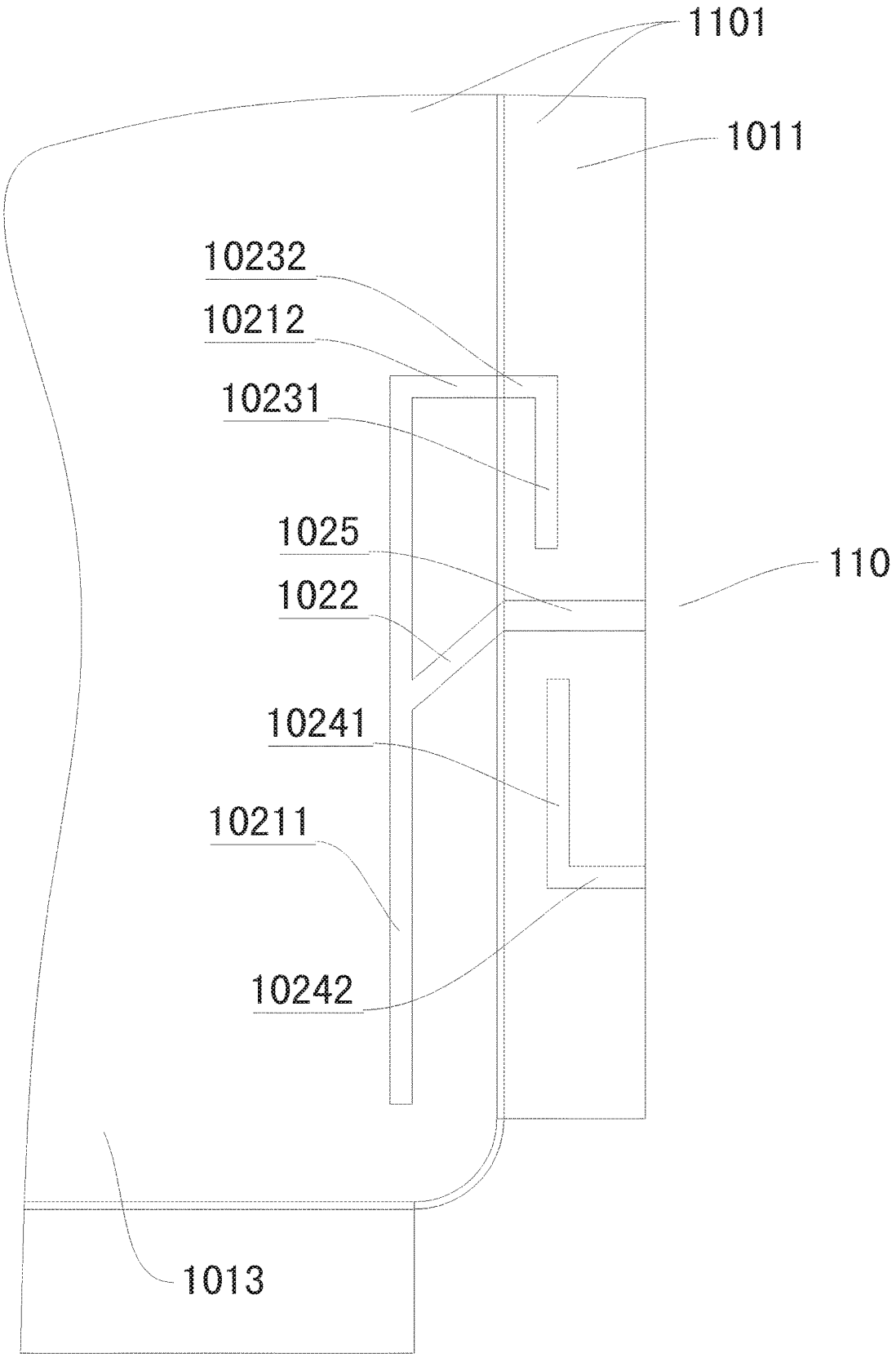
FIG. 14 is a schematic view of a first antenna according to another embodiment of the present disclosure.

FIG. 14 is a schematic view of a first antenna according to another embodiment of the present disclosure. As shown in FIG. 14, the first limb 10231 of the third L-shaped slot 1023 is located on the outer side of the outer edge of the second limb 10232 of the third L-shaped slot 1023.

In an embodiment, the first antenna 110 may be a WWAN antenna, that is, the first antenna 110 may cover WWAN. The first antenna 110 may include low-frequency resonance branches, the parasitic elements and the resonant slots. As shown in FIG. 2, the resonance branches L1, L3 and L4 generate a low-frequency resonance with a frequency of 842 MHz-960 MHz, the parasitic elements L2, L4 and L5 generate a first high-frequency resonance with a frequency of 1.71 GHz-2.17 GHz, the resonant slot (i.e., the first L-shaped slot 1024) generates a second high-frequency resonance with a frequency of 1.71 GHz-2.17 GHz.

In an embodiment, as shown in FIGS. 1, 2, and 5, the first L-shaped feeder 1027 has a first limb 10271 and a second limb 10272, an inner edge of the first limb 10271 is in flush with the outer edge of the first limb 10211 of the second L-shaped slot 1021 in the first inner and outer direction A of the metal shell, an outer edge of the second limb 10272 of the first L-shaped feeder 1027 is located on the outer side of the outer edge of the first limb 10211 of the second L-shaped slot 1021, and an inner edge of the second limb 10272 of the first L-shaped feeder 1027 is located on the inner side of the inner edge of the first limb 10211 of the second L-shaped slot 1021, such that the structure of the first antenna 110 can be more reasonable.

In an embodiment, a distance between an inner end of the first slot 1022 and the second limb 10212 of the second L-shaped slot 1021 is larger than a distance between an outer end of the first slot 1022 and the second limb 10212 of the second L-shaped slot 1021, As shown in FIG. 5, the second limb 10272 of the first L-shaped feeder 1027 has a first phase delay groove 10273, an outer edge of the first phase delay groove 10273 is located on the outer side of the outer edge of the first limb 10211 of the second L-shaped slot 1021, and an inner edge of the first phase delay groove 10273 is located on the inner side of the inner edge of the first limb 10211 of the second L-shaped slot 1021. By forming the first phase delay groove 10273 in the second limb 10272 of the first L-shaped feeder 1027, the first L-shaped feeder 1027 has a phase delay structure, which enables the first L-shaped feeder 1027 to generate two excitation signal with a certain phase difference therebetween, so as to excite out a plurality of similar resonance points, such that the bandwidth can be extended by a degeneracy of the resonant points.

In an embodiment, the resonant branch and the resonant slot of the first antenna 110 may be adjacent to an edge of the metal shell, thus reducing a clearance requirement of the first antenna 110 for a printed circuit board.

If the resonant branch, the parasitic element and the resonant slot of the first antenna 110 are close to each other, they may couple with each other, and thus appropriate sizes of the first antenna 110 may be determined based on a combination of a simulation and the actual product. In an embodiment, a length of the first limb 10211 of the second L-shaped slot 1021 is 48.54 mm, a width of the first limb 10211 of the second L-shaped slot 1021 is 1.5 mm, a length of the second limb 10212 of the second L-shaped slot 1021 is 11.26 mm, and a width of the second limb 10212 of the second L-shaped slot 1021 is 1.5 mm. A length of the first limb 10231 of the third L-shaped slot 1023 is 13 mm, a width of the first limb 10231 of the third L-shaped slot 1023 is 1.5 mm, a length of the second limb 10232 of the third L-shaped slot 1023 is 3.62 mm, and a width of the second limb 10232 of the third L-shaped slot 1023 is 1.5 mm.

A length of the first slot 1022 is 8.12 mm, a width of the first slot 1022 is 1.5 mm, a length of the second slot 1025 is 9.5 mm, and a width of the second slot 1025 is 1.5 mm. A length of the first limb 10241 of the first L-shaped slot 1024 is 25 mm, a width of the first limb 10241 of the first L-shaped slot 1024 is 1.5 mm, a length of the second limb 10242 of the first L-shaped slot 1024 is 6.6 mm, and a width of the second limb 10242 of the first L-shaped slot 1024 is 1.5 mm.

Figure 3:
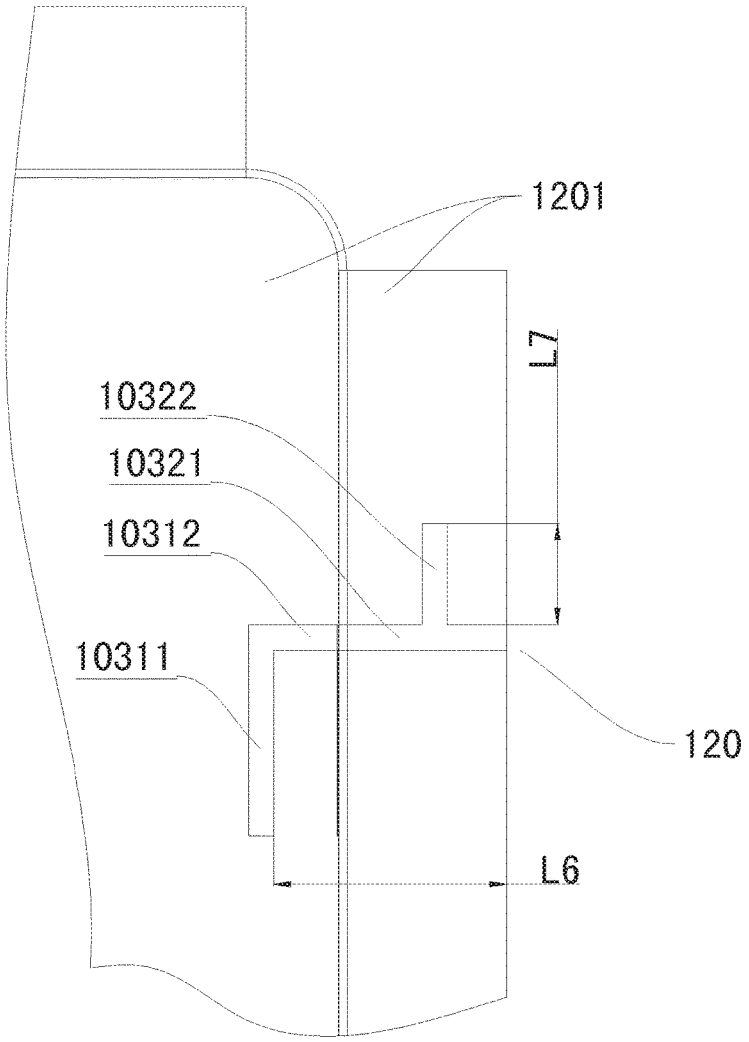
FIG. 3 is a schematic view of a second antenna according to an embodiment of the present disclosure.

FIG. 3 is a schematic view of a second antenna according to an embodiment of the present disclosure. As shown in FIGS. 1, 3 and 5, the second antenna 120 of the electronic device 10 includes: a second radiating surface 1201, a second dielectric sheet 1033, and a second L-shaped feeder 1034.

The second radiating surface 1201 includes the back metal shell part 1013 and the first side metal shell part 1011, that is, the back metal shell part 1013 and the first side metal shell part 1011 are used to form the second radiating surface 1201 of the second antenna 120. The second radiating surface 1201 has a T-shaped slot 1032 and a fourth L-shaped slot 1031. The T-shaped 1032 has a first limb 10321 and a second limb 10322, and is formed in the first side metal shell part 1011. The fourth L-shaped slot 1031 has a first limb 10311 and a second limb 10312, and is formed in the back metal shell part 1013. An outer end in the second limb 10312 of the fourth L-shaped slot 1031 is connected with an inner end of the first limb 10321 of the T-shaped slot 1032.

The second dielectric sheet 1033 is disposed on a front surface of the back metal shell part 1013. An outer edge of the second dielectric sheet 1033 is located on an outer side of an outer edge of the first limb 10311 of the fourth L-shaped slot 1031, an inner edge of the second dielectric sheet 1033 is located on an inner side of an inner edge of the first limb 10311 of the fourth L-shaped slot 1031, and a part of the second dielectric sheet 1033 is filled within or covers the T-shaped slot 1032. A second L-shaped feeder 1031 is disposed on a front surface of the second dielectric sheet 1033, and an edge of the second L-shaped feeder 1034 is located on an inner side of an edge of the second dielectric sheet 1033.

With the second antenna 120 of the electronic device 10 according to embodiments of the present disclosure, by using the back metal shell part 1013 and the first side metal shell part 1011 as the second radiating surface 1201, the second antenna 120 will not be shielded by the metal shell, such that the second antenna 120 can cover BT & Wifi. Moreover, with a part of the second dielectric sheet 1033 being filled within or covering the fourth L-shaped slot 1031, it is assured that the appearance of the electronic device cannot be affected by the slots, such that the second antenna 120 can be used for the actual product.

The second dielectric sheet 1033 may be made of plastic, and the second dielectric sheet 1033 may be combined with the metal shell together by using a plastics-metal molding (PMH) technology to ensure the strength of the metal shell.

The second antenna 120 may be a BT & Wifi (Bluetooth and wireless compatibility certification) antenna, the second antenna 120 may include a 2.4 GHz resonant branch and parasitic elements, which are formed by segmenting the fourth L-shaped 1031 and the T-shaped slot 1032, and the fourth L-shaped 1031 and the T-shaped slot 1032 can form a variant T-shaped slot. As shown FIG. 3, the resonant branch L6 generates a resonance with a frequency of 2.4 GHz, and the parasitic element L7 generates a resonance with a frequency of 5 GHz-6 GHz, and thus appropriate sizes of the second antenna 120 may be determined based on a combination of a simulation and the actual product.

In an embodiment, a length of the first limb 10311 of the fourth L-shaped slot 1031 is 12.5 mm, a width of the first limb 10311 of the fourth L-shaped slot 1031 is 1.5 mm, a length of the second limb 10312 of the fourth L-shaped slot 1031 is 10.54 mm, a width of the second limb 10312 of the fourth L-shaped slot 1031 is 1.5 mm. A length of the first limb 10321 of the T-shaped slot 1032 is 9.5 mm, a width of the first limb 10321 of the T-shaped slot 1032 is 1.5 mm, a length of the second limb 10322 of the T-shaped slot 1032 is 6 mm, and a width of the second limb 10322 of the T-shaped slot 1032 is 1.5 mm.

As shown in FIG. 5, the first limb 10341 of the second L-shaped feeder 1034 is located on an outer side of an outer edge of the first limb 10311 of the fourth L-shaped slot 1031, an outer edge of the second limb 10342 of the second L-shaped feeder 1034 is located on the outer side of the outer edge of the first limb 10311 of the fourth L-shaped slot 1031, and an inner edge of the second limb 10342 of the second L-shaped feeder 1034 is located on an inner side of an inner edge of the first limb 10311 of the fourth L-shaped slot 1031, such that the structure of the second antenna 120 can be more reasonable.

As shown in FIG. 5, the second limb 10342 of the second L-shaped feeder 1034 has a second phase delay groove 10343, an outer edge of the second phase delay groove 10343 is located on the outer side of the outer edge of the first limb 10311 of the fourth L-shaped slot 1031, and an inner edge of the second phase delay groove 10343 is located on the inner side of the inner edge of the first limb 10311 of the fourth L-shaped slot 1031.

By forming the second phase delay groove 10343 in the second limb 10342 of the second L-shaped feeder 1034, the second L-shaped feeder 1034 has a phase delay structure, which enables the second L-shaped feeder 1034 to generate two excitation signals with a certain phase difference therebetween, so as to excite out a plurality of similar resonance points, such that the bandwidth can be extended by a degeneracy of the resonant points.

Figure 4:
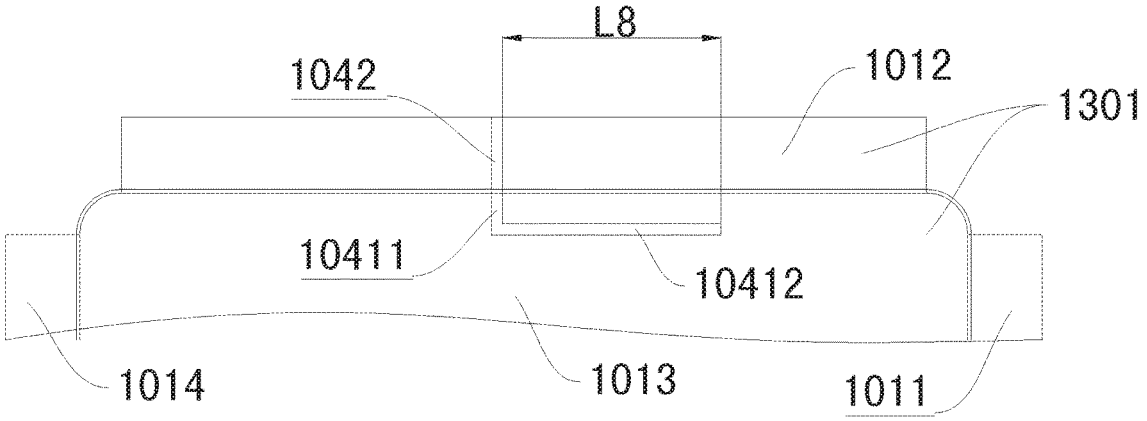
FIG. 4 is a schematic view of a third antenna according to an embodiment of the present disclosure.

FIG. 4 is a schematic view of a third antenna according to an embodiment of the present disclosure. As shown in FIGS. 1, 4 and 5, the third antenna 130 of the electronic device 10 includes: a third radiating surface 1301, a third dielectric sheet 1043, and a third L-shaped feeder 1044. The third radiating surface 1301 includes the back metal shell part 1013 and a second side metal shell part 1012, that is, the back metal shell part 1013 and the second side metal shell part 1012 are used to form the third radiating surface 1301 of the third antenna 130. The third radiating surface 1301 has a third slot 1042 and a fifth L-shaped slot 1041, the third slot 1042 is formed in the second side metal shell part 1012, the fifth L-shaped slot 1041 has a first limb 10411 and a second limb 10412 and is formed in the back metal shell part 1013, and an outer end of the first limb 10411 of the fifth L-shaped slot 1041 is connected with an inner end of the third slot 1042.

In an embodiment, the third dielectric sheet 1043 is disposed on a front surface of the back metal shell part 1013, an outer edge of the third dielectric sheet 1043 is located on an outer side of an outer edge of the second limb 10412 of the fifth L-shaped slot 1041, an inner edge of the third dielectric sheet 1043 is located on an inner side of an inner edge of the second limb 10412 of the fifth L-shaped slot 1041, and a part of the third dielectric sheet 1043 is filled within or covers the fifth L-shaped slot 1041. The third L-shaped feeder 1044 is disposed on front surface of the third dielectric sheet 1043, and an edge of the third L-shaped feeder 1044 is located on an inner side of an edge of the third dielectric sheet 1043, such that the third antenna 130 can cover GPS. Moreover, with a part of the third dielectric sheet 1034 being filled within or covering in the fifth L-shaped slot 1041, it is assured that the appearance of the electronic device 10 cannot be affected by the slots, such that the third antenna 130 can be used for the actual product.

The third dielectric sheet 1034 may be made of plastic, and the third dielectric sheet 1033 may be combined with the metal shell together by using a plastic-metal molding (PMH) technology to ensure the strength of the metal shell.

The third antenna 130 may be a GPS antenna, and the third antenna 130 may include a 1.575 GHz resonant branch, which is formed by segmenting the fifth L-shaped 1041. As shown FIG. 4, the resonant branch L8 generates a resonance with a frequency of 1.575 GHz.

In an embodiment, a length of the first limb 10411 of the fifth L-shaped slot 1041 is 6.1 mm, a width of the first limb 10411 of the fifth L-shaped slot 1041 is 1.5 mm, a length of the second limb 10412 of the fifth L-shaped slot 1041 is 30.8 mm, and a width of the second limb 10412 of the fifth L-shaped slot 1041 is 1.5 mm. A length of the third slot 1042 is 9.6 mm, and a width of the third slot 1042 is 1.5 mm.

As shown in FIG. 5, the third L-shaped feeder 1044 has a first limb 10441 and a second limb 10442. An inner edge of the second limb 10442 is in flush with the outer edge of the second limb 10412 of the fifth L-shaped slot 1041 in the second inner and outer direction B of the metal shell, an outer edge of the first limb 10441 of the third L-shaped feeder 1044 is located on the outer side of the outer edge of the second limb 10412 of the fifth L-shaped slot 1041, and an inner edge of the first limb 10441 of the third L-shaped feeder 1044 is located on the inner side of the inner edge of the second limb 10412 of the fifth L-shaped slot 1041, such that the structure of the third antenna 130 can be more reasonable.

In an embodiment, as shown in FIG. 5, the first limb 10441 of the third L-shaped feeder 1044 has a third phase delay groove 10443. An outer edge of the third phase delay groove 10443 is located on the outer side of the outer edge of the second limb 10412 of the fifth L-shaped slot 1041, and an inner edge of the third phase delay groove 10443 is located on the inner side of the inner edge of the second limb 10412 of the fifth L-shaped slot 1041. By forming the third phase delay groove 10443 in the second limb 10442 of the third L-shaped feeder 1044, the third L-shaped feeder 1044 has a phase delay structure, which enables the third L-shaped feeder 1044 to generate two excitation signals with a certain phase difference therebetween, so as to excite out a plurality of similar resonance points, such that the bandwidth can be extended by a degeneracy of the resonant points.

With the third antenna 130 of the electronic device 10 according to embodiments of the present disclosure, by using the back metal shell part 1013 and the second side metal shell part 1012 as the third radiating surface 1301, the third antenna 130 will not be shielded by the metal shell, such that the third antenna 130 can cover GPS. Moreover, with a part of the third dielectric sheet 1043 being filled within or covering the fifth L-shaped slot 1041, it is assured that the appearance of the electronic device 10 cannot be affected by the slots, such that the third antenna 130 can be used for the actual product.

In an embodiment in FIGS. 1 and 5, the fourth antenna 105 is symmetrical to the second antenna 120 with respect to a center line X-X' of the metal shell and has a fourth radiating surface 1051 formed by the third side metal shell part 1014 and the back metal shell part 1013. The fifth antenna 105 is symmetrical to the first antenna 110 with respect to the center line X-X' of the metal shell and has a fifth radiating surface 1061 formed by the third side metal shell part 1014 and the back metal shell part 1013. Therefore, the structure of the electric device may be more reasonable.

In an embodiment, the electronic device 10 includes: the metal shell and the first antenna 110 with the first radiating surface 1101 according to above embodiments of the present disclosure. The metal shell includes: the back metal shell part 1013, the first side metal shell part 1011, the second side metal shell part 1012 and the third side metal shell part 1014. The first radiating surface 1101 is formed by the back metal shell part 1013 and the first side metal shell part 1011.

In the embodiment, the electronic device 10 may further include at least one of the second antenna 120, the third antenna 130, the fourth antenna 105 and the fifth antenna 106 according to above embodiments of the present disclosure.

By disposing the first antenna, and at least one of the second antenna, the third antenna, the fourth antenna and the fifth antenna, the electronic device according to the embodiment of the present disclosure can cover at least one of WWAN, BT & Wifi and GPS. Moreover, with the part of the dielectric layer being filled within or covering the slot, the appearance of the electronic device cannot be affected by the slots, and thus the above antennas can be used for the actual product.

In an embodiment, the electronic device 10 includes the first antenna 110, the second antenna 120 and the third antenna 130, which can cover WWAN/BT & Wifi/GPS respectively. Each of the first antenna 110, the second antenna 120 and the third antenna 130 may be capable of coupling feed, and thus a welding problem of aluminum alloy can be solved.

In an embodiment, the antenna in the electronic device 10 is a planar inverted F (PIFA) antenna connected with a capacitor in series, instead of a slot antenna.

The first dielectric sheet 1026, the second dielectric sheet 1033 and the third dielectric sheet 1043 provide a place for the antenna matching. Each of the first dielectric sheet 1026, the second dielectric sheet 1033 and the third dielectric sheet 1043 may be made of polycarbonate (PC). A dielectric constant of each of the first dielectric sheet 1026, the second dielectric sheet 1033 and the third dielectric sheet 1043 may be 3, and a thickness of each of the first dielectric sheet 1026, the second dielectric sheet 1033 and the third dielectric sheet 1043 may be 1.5 mm.

Each of the first dielectric sheet 1026, the second dielectric sheet 1033 and the third dielectric sheet 1043 may have a matching circuit. A projection of each of the first dielectric sheet 1026, the second dielectric sheet 1033 and the third dielectric sheet 1043 in a horizontal plane may be fallen into a gap between a screen of the electronic device screen 10 and a frame of the electronic device screen 10. A region of the printed circuit board, which is opposed to the projection of each of the first dielectric sheet 1026, the second dielectric sheet 1033 and the third dielectric sheet 1043 in the horizontal plane, needs to be cleared, so as to avoid generating a parasitic capacitance which may affect the performance of the antenna.

The first L-shaped feeder 1027 may vertically pass over the first limb 10211 of the second L-shaped slot 1021, and an end of the first limb 10271 of the second L-shaped feeder 1027 may be parallel with the first limb 10211 of the second L-shaped slot 1021. The second L-shaped feeder 1034 may vertically pass over the first limb 10311 of the fourth L-shaped slot 1031, and an end of the second L-shaped feeder may be parallel with the first limb 10311 of the fourth L-shaped slot 1031. The third L-shaped feeder 1044 may vertically pass over the second limb 10412 of the fifth L-shaped slot 1041, and an end of the third L-shaped feeder 1044 may be parallel with the second limb 10412 of the fifth L-shaped slot 1041.

The above antennas for the electronic device 10 are the PIFA antennas connected with a capacitor in series, a debugging mode of the antenna is similar to that of the PIFA antenna, and the resonance is generated if a length of the resonance branch is a quarter of a wave length. Due to a complicated internal environment of the electronic device 10, a metal element and material filled in the slot, which are close to each other, may reduce a resonance frequency of the antenna. A width of the resonance branch may also affect an electrical length of the resonance branch, and thus the length of the resonance branch can be increased or decreased within a certain range so as to generate the resonance in a intended position, and a final size of the antenna may be determined based on a combination of an actual debugging and a simulation debugging.

A length of the back metal shell part 1013 may be 178 mm, and a width of the back metal shell part 1013 may be 108 mm. A length of the first side metal shell part 1011 may be 178 mm, and a width of the first side metal shell part 1011 may be 9.5 mm. A length of the second side metal shell part 1012 may be 108 mm, and a width of the second side metal shell part 1012 may be 9.5 mm.

The first L-shaped feeder 1027, the second L-shaped feeder 1034 and the third L-shaped feeder 1044 are connected with a coaxial cable. A size of the first phase delay groove 10273 (i.e., a rectangular groove) is 2.3 mm*4.4 mm, that is, the rectangular groove with a size of 2.3 mm*4.4 mm is formed in a rectangle with a size of 5.3 mm*7.4 mm, and another rectangle with a size of 2.25 mm*13.8 mm is extended inward along the slot in the back metal shell part 1013 from the rectangle with the size of 5.3 mm*7.4 mm, so as to form the first L-shaped feeder 1027. A size of the second phase delay groove 10343 (i.e., a rectangular groove) is 2.24 mm*3 mm, that is, the rectangular groove with a size of 2.24 mm*3 mm is formed in a rectangle with a size of 5.34 mm*6 mm, and another rectangle with a size of 2.5 mm*2.91 mm is extended inward along the slot in the back metal shell part 1013 from the rectangle with the size of 5.34 mm*6 mm, so as to form the second L-shaped feeder 1034. A formation of the third L-shaped feeder 1044 is similar to those of the first L-shaped feeder 1027 and the second L-shaped feeder 1034, and is omitted herein.

Figure 9:
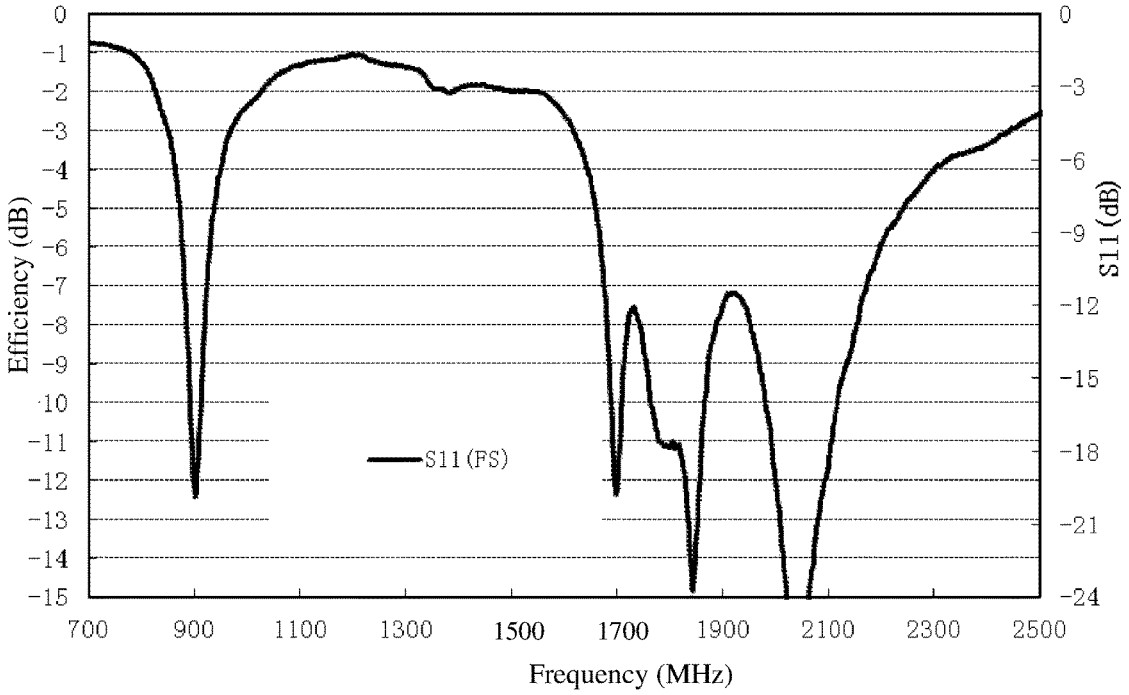
FIG. 9 is a schematic diagram of a return loss of a main antenna of the first antenna according to an embodiment of the present disclosure.

FIG. 9 is a schematic view of a return loss of a main antenna of the first antenna according to an embodiment of the present disclosure. The return loss is represented as S11, the resonance thereof covers five communication bands, namely GSM850, GSM900, GSM1800, GSM1900 and UMTS, and an efficiency of the first antenna 110 is larger than 35%.

Figure 10:
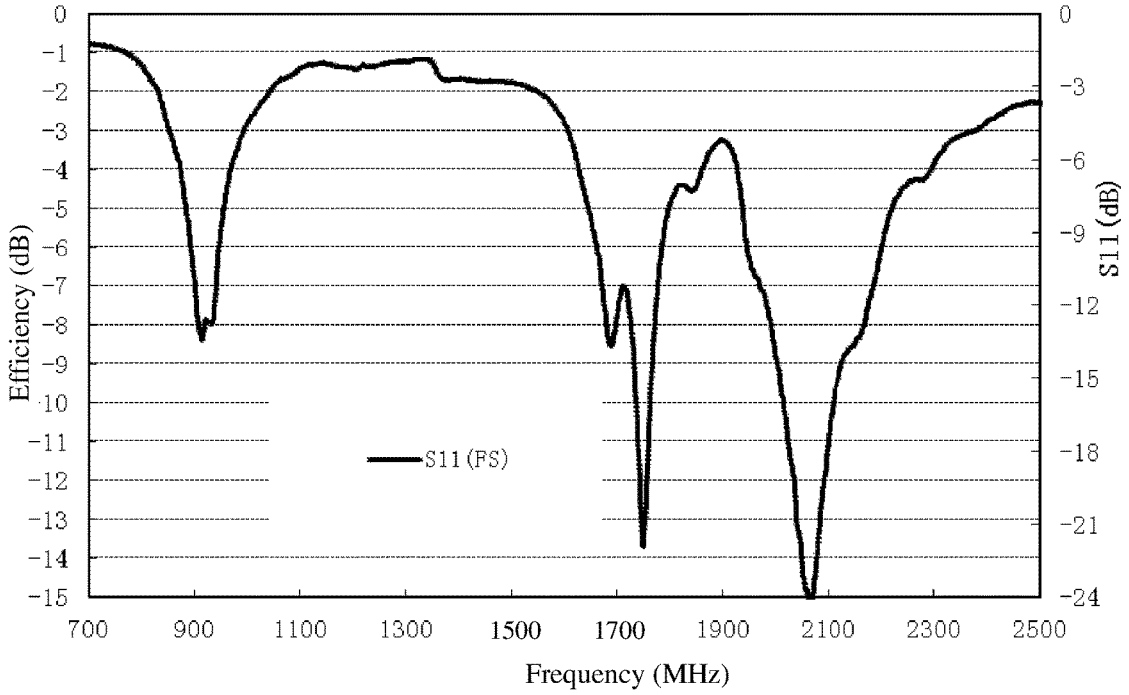
FIG. 10 is a schematic diagram of a return loss of a slave antenna of the first antenna according to an embodiment of the present disclosure.

FIG. 10 is a schematic view of a return loss of a slave antenna of the first antenna according to an embodiment of the present disclosure. The return loss is represented as S11, and the resonance thereof covers one communication band of UMTS RX. The efficiency of the first antenna 110 is larger than 40%.

Figure 11:
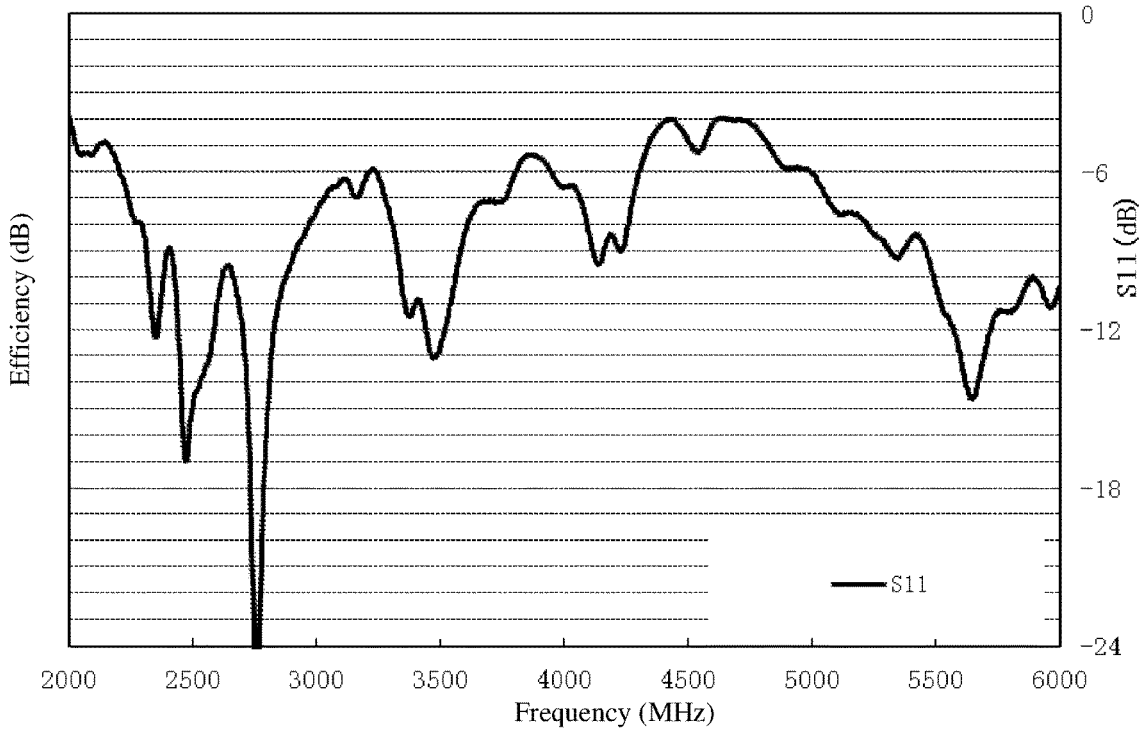
FIG. 11 is a schematic diagram of a return loss of a main antenna of the second antenna according to an embodiment of the present disclosure.

FIG. 11 is a schematic view of a return loss of a main antenna of the second antenna according to an embodiment of the present disclosure. The return loss is represented as S11, and the resonance thereof covers bands of 2.4G/5G. The efficiency of the second antenna 120 is larger than 40%.

Figure 12:
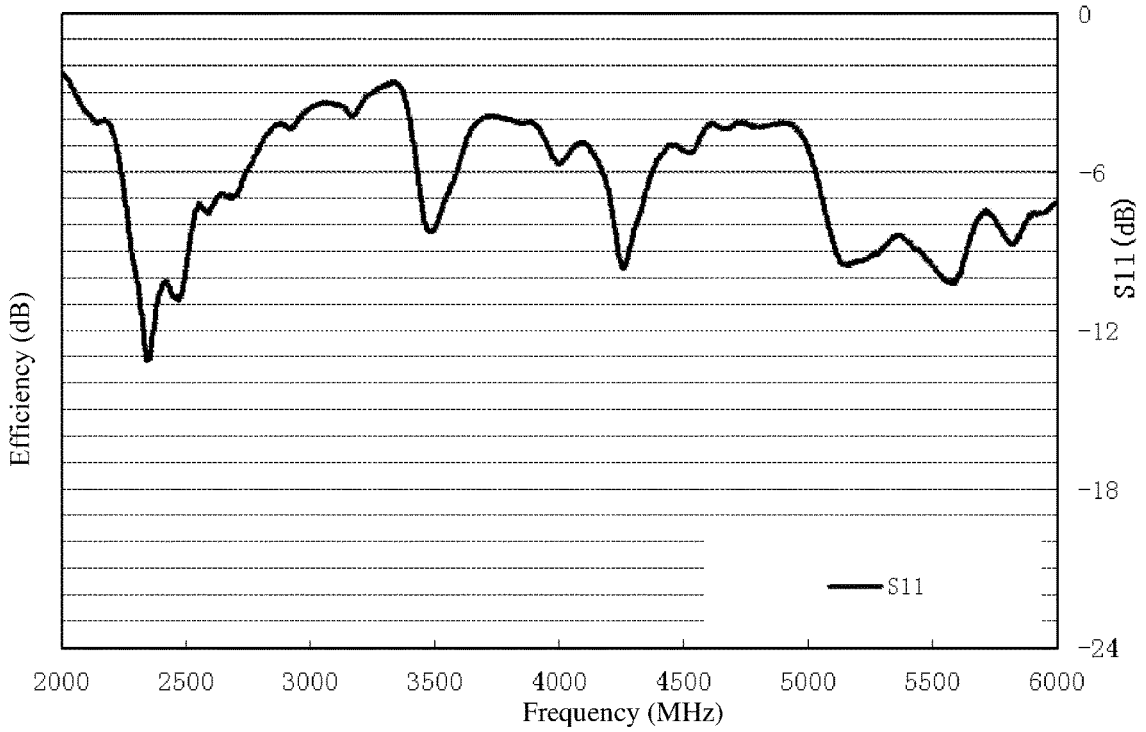
FIG. 12 is a schematic diagram of a return loss of a slave antenna of the second antenna according to an embodiment of the present disclosure.

FIG. 12 is a schematic view of a return loss of a slave antenna of the second antenna according to an embodiment of the present disclosure. The return loss is represented as S11, and the resonance thereof covers bands 2.4G/5G. The efficiency of the second antenna 120 is larger than 35%.

Figure 13:
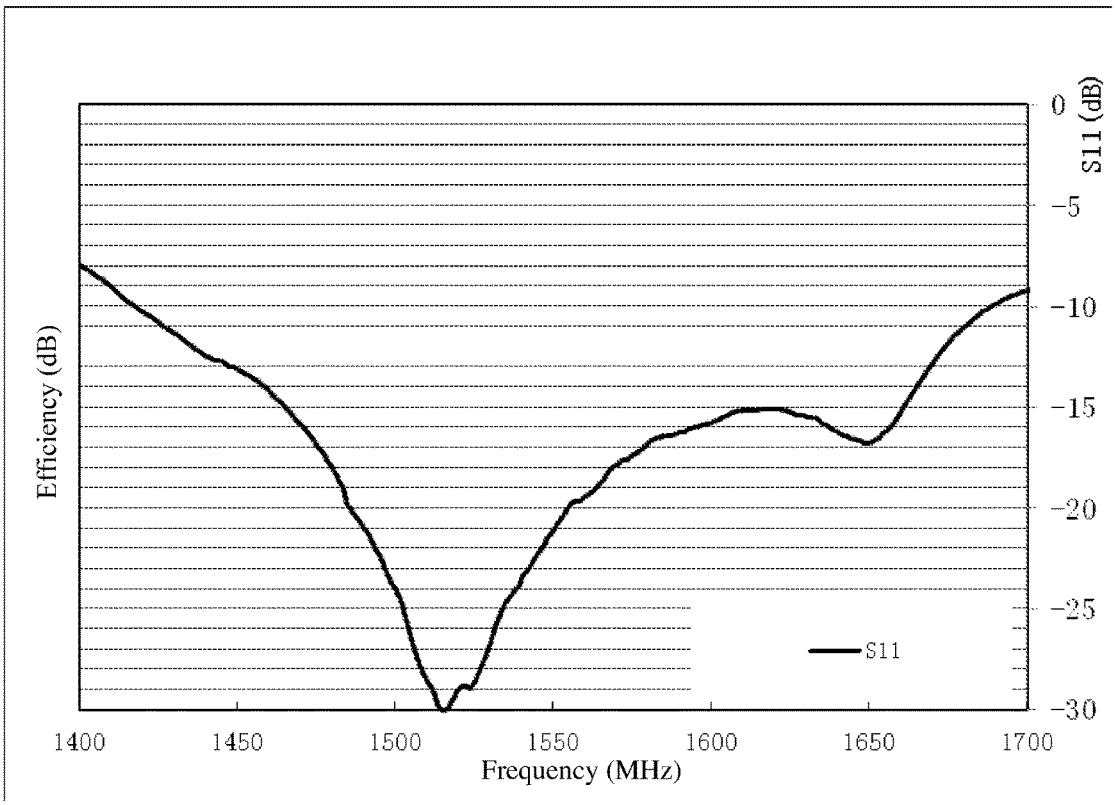
FIG. 13 is a schematic diagram of a return loss of a main antenna of the third antenna according to an embodiment of the present disclosure.

FIG. 13 is a schematic view of a return loss of a main antenna of the third antenna according to an embodiment of the present disclosure. The return loss is represented as S11, and the resonance thereof covers bands of 1.5 GHz-1.7 GHz. The efficiency of the third antenna 130 is larger than 50%.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A first antenna of an electronic device, the electric device comprising a metal shell which has a back metal shell part and a first side metal shell part, the first antenna comprising:

a first radiating surface formed by the back metal shell part and the first side metal shell part and having a variant T-shaped group of slots and a first L-shaped slot, a part of the variant T-shaped group of slots being formed in the back metal shell part, and the other part of the variant T-shaped group of slots being formed in the first side metal shell part, the first L-shaped slot being formed in the first side metal shell part;

a first dielectric sheet disposed on a front surface of the back metal shell part, a part of the first dielectric sheet being filled within or covering the variant T-shaped group of slots; and a first L-shaped feeder disposed on a front surface of the first dielectric sheet and having a first limb and a second limb, an edge of the first L-shaped feeder being located on an inner side of an edge of the first dielectric sheet, wherein the variant T-shaped group of slots comprises:

a first slot formed in the back metal shell part, a second slot formed in the first side metal shell part, a second L-shaped slot having a first limb and a second limb, and formed in the back metal shell part, a third L-shaped slot having a first limb and a second limb, and formed in the first side metal shell part, wherein an inner end of the first slot is connected with the first limb of the second L-shaped slot, an outer end of the first slot is connected with an inner end of the second slot, an outer end of the second limb of the second L-shaped slot is connected with an inner end of the second limb of the third L-shaped slot, an outer edge of the first dielectric sheet is located on an outer side of an outer edge of the first limb of the second L-shaped slot, and an inner edge of the first dielectric sheet is located on an inner side of an inner edge of the first limb of the second L-shaped slot.

2. The first antenna of claim 1, wherein the first L-shaped feeder has a first limb and a second limb, an inner edge of the first limb of the first L-shaped feeder is in flush with the outer edge of the first limb of the second L-shaped slot in a first inner and outer direction of the metal shell, an outer edge of the second limb of the first L-shaped feeder is located on the outer side of the outer edge of the first limb of the second L-shaped slot, and an inner edge of the second limb of the first L-shaped feeder is located on the inner side of the inner edge of the first limb of the second L-shaped slot.

3. The first antenna of claim 1, wherein a first phase delay groove is formed in the second limb of the first L-shaped feeder, an outer edge of the first phase delay groove is located on the outer side of the outer edge of the first limb of the second L-shaped slot, and an inner edge of the first phase delay groove is located on the inner side of the inner edge of the first limb of the second L-shaped slot.

4. The first antenna of claim 1, wherein a distance between the inner end of the first slot and the second limb of the second L-shaped slot is larger than a distance between the outer end of the first slot and the second limb of the second L-shaped slot.

5. A second antenna of an electronic device, the electronic device comprising a metal shell which has a back metal shell part and a first side metal shell part, the antenna comprising:

a second radiating surface formed by the back metal shell part and the first side metal shell part and having a T-shaped slot and a fourth L-shaped slot, the T-shaped slot being formed in the first side metal shell part and having a first limb and a second limb, the fourth L-shaped slot being formed in the back metal shell part and having a first limb and a second limb, an outer end of the second limb of the fourth L-shaped slot being connected with an inner end of the first limb of the T-shaped slot;

a second dielectric sheet disposed on a front surface of the back metal shell part, an outer edge of the second dielectric sheet being located on an outer side of an outer edge of the first limb of the fourth L-shaped slot, an inner edge of the second dielectric sheet being located on an inner side of an inner edge of the first limb of the fourth L-shaped slot, and a part of the second dielectric sheet being filled within or covering the fourth L-shaped slot; and a second L-shaped feeder disposed on front surface of the second dielectric sheet and having a first limb and a second limb, an edge of the second L-shaped feeder being located on an inner side of an edge of the second dielectric sheet.

6. The second antenna of claim 5, wherein the first limb of the second L-shaped feeder is located on the outer side of the outer edge of the first limb of the fourth L-shaped slot, an outer edge of the second limb of the second L-shaped feeder is located on the outer side of the outer edge of the first limb of the fourth L-shaped slot, and an inner edge of the second limb of the second L-shaped feeder is located on the inner side of the inner edge of the first limb of the fourth L-shaped slot.

7. The second antenna of claim 5, wherein a second phase delay groove is formed in the second limb of the second L-shaped feeder, an outer edge of the second phase delay groove is located on the outer side of the outer edge of the first limb of the fourth L-shaped slot, and an inner edge of the second phase delay groove is located on the inner side of the inner edge of the first limb of the fourth L-shaped slot.

8. An electronic device, comprising:

a metal shell, comprising a back metal shell part, a first side metal shell part and a second side metal shell part; and a first antenna comprising:

a first radiating surface formed by the back metal shell part and the first side metal shell part and having a variant T-shaped group of slots and a first L-shaped slot, a part of the variant T-shaped group of slots being formed in the back metal shell part, and the other part of the variant T-shaped group of slots being formed in the first side metal shell part, the first L-shaped slot being formed in the first side metal shell part;

a first dielectric sheet disposed on a front surface of the back metal shell part, a part of the first dielectric sheet being filled within or covering the variant T-shaped group of slots; and a first L-shaped feeder disposed on a front surface of the first dielectric sheet and having a first limb and a second limb, an edge of the first L-shaped feeder being located on an inner side of an edge of the first dielectric sheet, wherein the variant T-shaped group of slots comprises:

a first slot formed in the back metal shell part, a second slot formed in the first side metal shell part, a second L-shaped slot having a first limb and a second limb, and formed in the back metal shell part, a third L-shaped slot having a first limb and a second limb, and formed in the first side metal shell part, wherein an inner end of the first slot is connected with the first limb of the second L-shaped slot, an outer end of the first slot is connected with an inner end of the second slot, an outer end of the second limb of the second L-shaped slot is connected with an inner end of the second limb of the third L-shaped slot, an outer edge of the first dielectric sheet is located on an outer side of an outer edge of the first limb of the second L-shaped slot, and an inner edge of the first dielectric sheet is located on an inner side of an inner edge of the first limb of the second L-shaped slot.

9. The electronic device of claim 8 further comprising a second antenna, wherein the second antenna comprising:

a second radiating surface formed by the back metal shell part and the first side metal shell part and having a T-shaped slot and a fourth L-shaped slot, the T-shaped slot being formed in the first side metal shell part and having a first limb and a second limb, the fourth L-shaped slot being formed in the back metal shell part and having a first limb and a second limb, an outer end of the second limb of the fourth L-shaped slot being connected with an inner end of the first limb of the T-shaped slot;

a second dielectric sheet disposed on a front surface of the back metal shell part, an outer edge of the second dielectric sheet being located on an outer side of an outer edge of the first limb of the fourth L-shaped slot, an inner edge of the second dielectric sheet being located on an inner side of an inner edge of the first limb of the fourth L-shaped slot, and a part of the second dielectric sheet being filled within or covering the fourth L-shaped slot; and a second L-shaped feeder disposed on front surface of the second dielectric sheet and having a first limb and a second limb, an edge of the second L-shaped feeder being located on an inner side of an edge of the second dielectric sheet.

10. The electronic device of claim 9, comprising a third antenna which comprises:

a third radiating surface formed by the back metal shell part and the second side metal shell part and having a third slot and a fifth L-shaped slot, the third slot being formed in the second side metal shell part, the fifth L-shaped slot having a first limb and a second limb and being formed in the back metal shell part, and an outer end of the first limb of the fifth L-shaped slot being connected with an inner end of the third slot;

a third dielectric sheet disposed on an front surface of the back metal shell part, an outer edge of the third dielectric sheet is located on an outer side of an outer edge of the second limb of the fifth L-shaped slot, an inner edge of the third dielectric sheet being located on an inner side of an inner edge of the second limb of the fifth L-shaped slot, and a part of the third dielectric sheet being filled within or covering the fifth L-shaped slot; and a third L-shaped feeder disposed on front surface of the third dielectric sheet, an edge of the third L-shaped feeder being located on an inner side of an edge of the third dielectric sheet.

11. The electronic device of claim 10, wherein the third L-shaped feeder has a first limb and a second limb, an inner edge of the second limb of the third L-shaped feeder is in flush with the outer edge of the second limb of the fifth L-shaped slot in a second inner and outer direction of the metal shell, an outer edge of the first limb of the third L-shaped feeder is located on the outer side of the outer edge of the second limb of the fifth L-shaped slot, and an inner edge of the first limb of the third L-shaped feeder is located on the inner side of the inner edge of the second limb of the fifth L-shaped slot.

12. The electronic device of claim 11, wherein a third phase delay groove is formed in the first limb of the third L-shaped feeder, an outer edge of the third phase delay groove is located on the outer side of the outer edge of the second limb of the fifth L-shaped slot, and an inner edge of the third phase delay groove is located on the inner side of the inner edge of the second limb of the fifth L-shaped slot.

13. The electronic device of claim 10, comprising a fourth antenna, symmetrical to the second antenna with respect to a center line of the metal shell.

14. The electronic device of claim 13, comprising: a fifth antenna, symmetrical to the first antenna with respect to a center line of the metal shell.

* * * * *